United States Patent [19]

Fanghanel

[11] 4,067,269

[45] Jan. 10, 1978

[54] TAPE EDGE CLOSING MACHINE

[75] Inventor: Peter Frederick Walter Fanghanel, Baldock, England

[73] Assignee: P. Fanghanel & Co. Ltd., United Kingdom

[21] Appl. No.: 698,982

[22] Filed: June 23, 1976

[30] Foreign Application Priority Data

June 30, 1975 United Kingdom ..... 27519/75

[51] Int. Cl.[2] ..... D05B 11/00

[52] U.S. Cl. ..... 112/3 R

[58] Field of Search ..... 112/3 R, 3 A, 121.15, 112/121.11, 121.12, 153, 203, 204

[56] References Cited

U.S. PATENT DOCUMENTS

| | | | |
|---|---|---|---|
| 1,322,842 | 11/1919 | Sutton | 112/3 R |
| 3,083,654 | 4/1963 | Cash | 112/3 R |
| 3,496,891 | 2/1970 | Kosrow et al. | 112/153 X |
| 3,641,954 | 2/1972 | Kalning et al. | 112/3 R |
| 3,889,614 | 6/1975 | Nicolay et al. | 112/153 |

*Primary Examiner*—H. Hampton Hunter

*Attorney, Agent, or Firm*—Blum, Moscovitz, Friedman & Kaplan

[57] ABSTRACT

This invention concerns a tension relieving device to be used in conjunction with a sewing machine in a tape edge closing machine for making mattresses and includes a wheel in advance of the sewing machine to bear against a surface of the mattress to relieve tension in the material of the mattress in order to facilitate feeding the material to the sewing machine and may include a second wheel to assist in maintaining the tension relief.

9 Claims, 4 Drawing Figures

FIG. 2
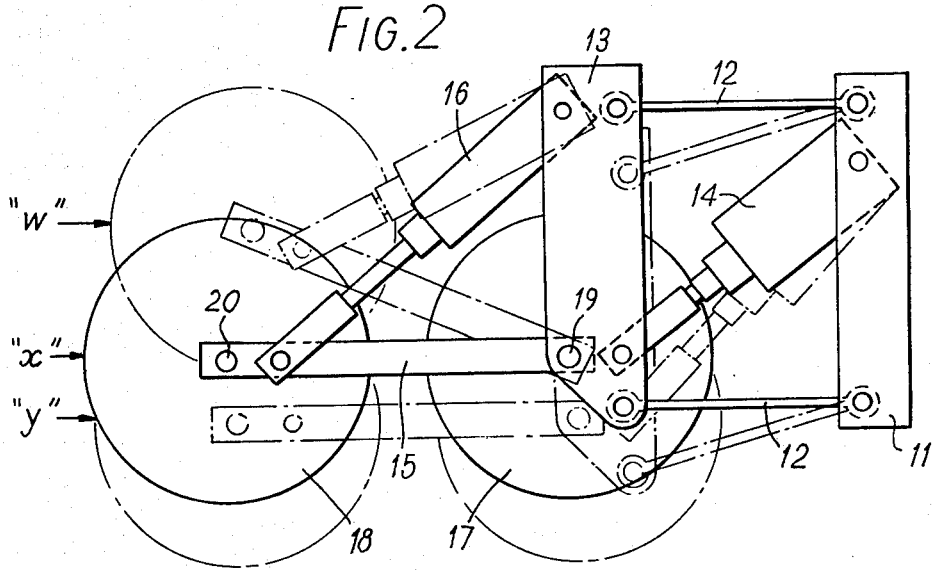
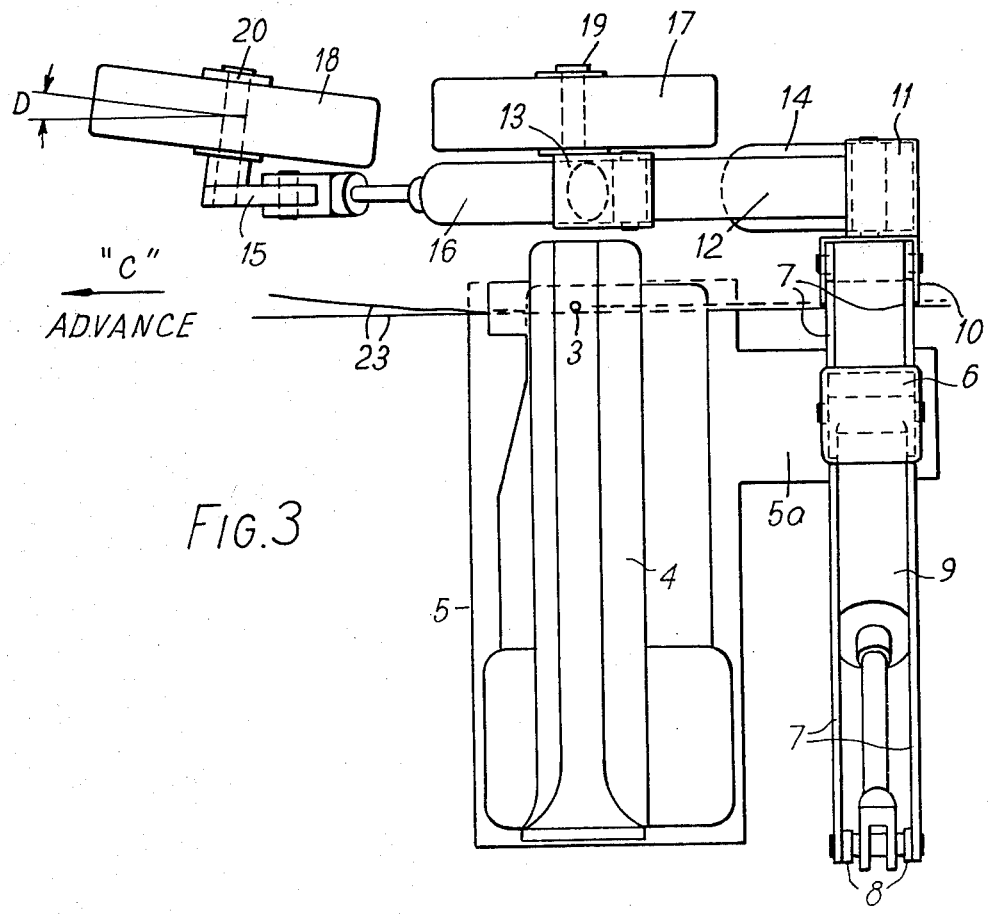
FIG. 3

TAPE EDGE CLOSING MACHINE

BACKGROUND OF THE INVENTION

This invention relates to mattress making machinery and in particular to a Tape Edge Closing machine. The present invention is particularly suitable for incorporation with tape edge closing machines as described in my co-pending application Ser. No. 671,870 filed Mar. 30, 1976, now U.S. Pat. No. 4,043,282, but it will be understood that other such machines may be used.

It is a well known process to close a mattress by sewing along its top edge, thereby joining the edge of the panel to the edge of the border boxing with the inter-position of a re-inforcing tape. With the modern construction of mattresses requiring the mattress cover to be under tension immediately after the aforementioned closing operation, the greater this tension is, the greater the difficulty which the operator of the tape edge closing machine will experience.

The object of this invention is to provide a mechanism carried with the sewing head and which when applied to the surface of the mattress, in conjunction with the movement of the surface of the mattress relative to the sewing head, will relieve the aforementioned tension and assist the operator to feed the edges of the top panel and side boxing of the mattress into the mouth of the sewing machine.

According to one aspect of the present invention there is provided a mattress tape edge closing machine comprising a sewing machine movable relative to a mattress on a carrier therefor, a de-tensioning apparatus carried with the sewing machine and having a first wheel in advance of the sewing head of the machine and being selectively movable into and out of engagement with the upper surface of a mattress in the carrier. Preferably the wheel is cylindrical and has its axis disposed horizontally the plane of the wheel being at an angle to the direction of relative movement between the mattress and the sewing machine. A second wheel may be carried by the apparatus to be movable towards and away from the mattress in register with the sewing head. Advantageously the second wheel is movable between upper and lower mattress engaging positions. The first wheel may be arranged to move with the second wheel between upper and lower mattress engaging positions and in addition be movable out of engagement with the mattress while the second wheel remains in engagement with the mattress.

Preferably both wheels are movable together towards and away from the mattress independently of relative movement between them.

The above and other aspects of the invention will now be described by way of example with reference to the accompanying drawings in which:

FIG. 2 is a side elevational view of the apparatus shown in FIG. 1;

FIG. 3 is a plan view of the apparatus and the sewing head of the tape edge closing machine and FIG. 4 is a view similar to FIG. 1 of a modified arrangement.

Figure 1:
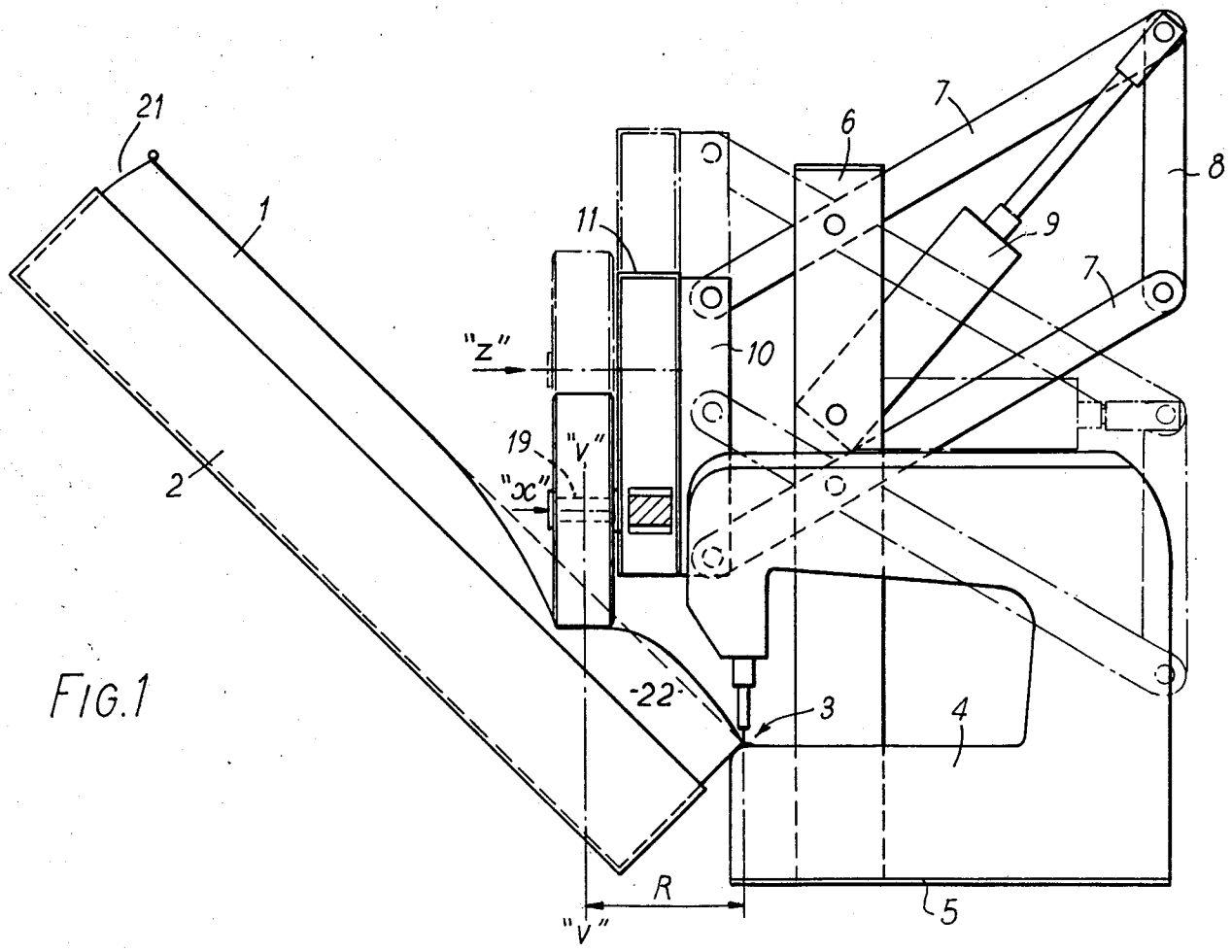
FIG. 1 shows diagrammatically, in end elevation, a tape edge closing machine incorporating apparatus according to the present invention.
Figure 4:
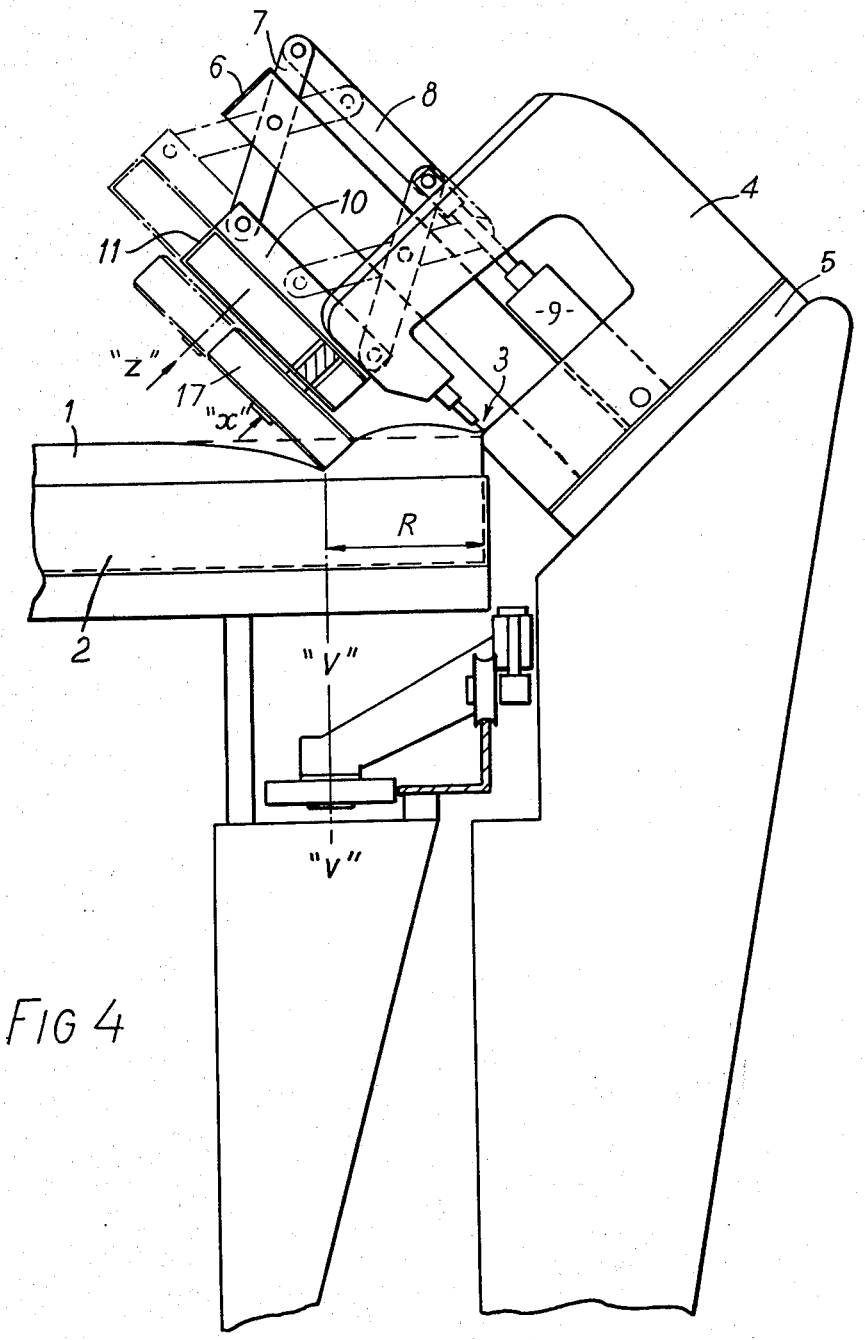

Referring to FIGS. 1 and 4, a mattress to be closed is indicated generally at 1 and is contained in an open topped box 2, so that the two edges to be sewn together are presented at 3 to a sewing machine 4. FIG. 1 shows an arrangement in which the sewing machine is disposed horizontally and the mattress is inclined thereto, and FIG. 4 shows an arrangement in which the sewing head is inclined to the horizontal and the mattress is laid horizontally on the table.

The sewing machine 4 is mounted on a base plate 5 which, as shown in FIG. 3, has an extension 5*a*. A hollow column 6 is mounted on the extension 5*a* and carries two pairs of levers 7 pivoted to the column intermediate their lengths and coupled together by links 8 and actuated by a hydraulic or pneumatic cylinder 9 also pivoted to the column 6. The opposite end of the levers is linked by a channel member 10 carrying a further member 11.

Actuation of the cylinder 9 will cause the levers 7 to move in parallel motion and so raise and lower the members 10 and 11 between positions shown in full and in chain lines in FIG. 1. The member 11 carries two pivoted links 12 and a pivoted hydraulic or pneumatic cylinder 14. The links 12 are also pivoted to another hollow member 13 so that they form another parallel motion unit under the action of the cylinder 14.

The member 13 near its lower end carries a fixed spindle 19, on which is mounted a freely rotatable wheel 17. Also on the spindle 19 and within the member 13 a link 15 is pivoted and carries at its other end a fixed spindle 20 on which is mounted a freely rotatable wheel 18. With reference to FIG. 3, it will be seen that the spindle 20 is mounted in such a way that the wheel 18 makes an angle D with the plane of the wheel 17.

The link 15 is connected with a hydraulic or pneumatic cylinder 16 pivoted at its other end inside the member 13. With reference to FIGS. 1 and 2 it can be seen that the operation of cylinder 16 gives a choice of two positions for the leading wheel 18. With the cylinder 16 retracted the wheel 18 is raised to the level "*w*". When the cylinder 16 is extended, the link 15 will be horizontal, and the wheel 18 will be at the same level "*x*" as the wheel 17.

Additionally with the cylinder 16 extended then when the cylinder 14 is retracted both wheels 17 and 18 will be at level "*x*" and when the cylinder 14 is extended the wheels 17 and 18 will be at level "*y*".

Similarly when the cylinder 9 is retracted, both wheels 17 and 18 will be lifted up clear of the surface of the mattress 1 to the level "*z*". When the cylinder 9 is extended, both wheels 17 and 18 will be pressed down into the surface of the mattress to the level "*x*" or "*y*" depending on whether cylinder 14 is retracted or extended.

In operation, closing the mattress proceeds by sewing along the first side and then the first end of the mattress, during which time the top is generally not under tension. During this operation the cylinder 9 will be retracted and the wheels will be raised to the level "*z*" clear of the mattress surface.

When the sewing reaches the second side, the cylinders 9 and 16 will be extended and the two wheels 17 and 18 will come down to the level "*x*". The effect of pressing the two wheels into the surface of the mattress at an angle will cause the surface to be pulled away from the opposite edge 21 and cause a loosening of tension in the surface at 22, so facilitating joining the edges together at 3.

Referring to FIG. 1, the sewing head 14 advances along the edge of the mattress in the direction generally indicated as "advance" "*c*" in FIG. 3. This motion is of course relative to the mattress only and it will be appreciated that the effect is the same whether the mattress is fixed in position and the sewing head moves on a carriage along its edge, or whether the sewing head is fixed in position and the mattress is carried in a movable carriage past the sewing head.

Referring to FIG. 3, the wheel 18 is mounted at an angle "D" relative to the wheel 17 so that when the sewing head, base plate 5 and mechanism advance together along the surface of the mattress in the general direction "*c*", the effect of having the wheel 18 mounted at an angle "D" is to produce a steering action by the inter-action of the wheel 18 on the surface of the mattress as it advances. This steering action is resisted by the rigid column 6 so that the frictional reaction of the leading wheel 18 on the surface of the mattress tends to pull the material down from the opposite edge 21 and produce a surplus of material at 22. Referring to FIG. 3, the edges to be joined are indicated at 23 and the needle position at 3.

The leading wheel 18 is mounted so that it is ahead of the sewing machine 4 as it advances in the direction of "*c*" and in such a position that there is room for the operator's hands to grasp the two edges 23 and so guide them into the mouth of the sewing machine. The following wheel 17 has the function of maintaining the tension relief induced by the leading wheel 18.

For convenience the wheel 17 is so mounted between the mattress 1 and the sewing head 4, that the axis at right angles to the wheel's axis of rotation generally coincides with the centre of curvature of the corners of the mattress-closing machine at a radius R (as shown in FIG. 1) and a vertical line through the lowest point of wheel 17 (FIG. 4) coincides with the same centre of curvature, so that when the sewing operation reaches the round corners of the mattress, the surface of the mattress will tend to pivot under the wheel 17, generally on the vertical axis "*vv*".

It will thus be apparent that when the sewing action reaches the end of one side or end and the surface is to pivot under the wheel 17, it will be necessary to lift the wheel 18 clear of the surface, to enable the sewing action to describe a quarter circle to close the corners of the mattress. This requirement is achieved by retracting the cylinder 16 and so lifting the wheel 18 to the level "*w*".

While the actions of the three cylinders are under the control of the operator of the machine, in addition the actions of cylinders 14 and 16 will be under the control of switches or valves (not shown) which will be actuated by cam plates (not shown) attached to the structure of the machine (not shown) in such a way that the leading wheel 18 will be automatically raised when the sewing reaches the start of the corner curvature and automatically lowered again when the sewing has passed the corner and reaches the next straight piece.

The two levels "*x*" and "*y*" of the wheel 17 and 18 are necessary to provide equal penetration into the surface of a rectangular mattress when the mattress is pivoted to the horizontal about a fixed central position. This is because a rectangular mattress when so pivoted will produce a steeper angle when tilted towards one side then when it is tilted towards one end.

The motion produced by cylinder 14 is not essential for a square mattress, round mattress or on tape edge closing machines where the mattress is horizontal and the sewing head is kept at a fixed angle to the horizontal when sewing the sides and the ends (as shown in FIG. 4).

Cylinder 14 can also be actuated similarly to cylinder 16 by the inter-action of a switch or valve with a cam plate fitted to the structure of the machine.

Although the wheel 17 described above is cylindrical it will be understood that it may be conical and rotate on an axis parallel with the axis of the wheel 18. Also it would be possible to drive the wheels 17 and 18 to increase the de-tensioning effect.

We claim:

1. A mattress tape edge closing machine comprising a sewing machine movable relative to a mattress on a carrier therefor; means for holding the mattress stationary relative to the carrier; a de-tensioning apparatus carried with the sewing machine, a first cylindrical wheel of said apparatus in advance of the sewing head of the machine and means for selectively moving said first wheel into and out of an operative position in which it depresses the upper surface of a mattress on the carrier against the natural resiliency of the mattress so as to relieve tension in an edge part of said upper surface immediately in advance of the sewing head while the mattress remains stationary relative to the carrier.

2. A mattress tape edge closing machine comprising a sewing machine movable relative to a mattress on a carrier therefor; means for holding the mattress stationary relative to the carrier; a de-tensioning apparatus carried with the sewing machine, a first cylindrical wheel of said apparatus in advance of the sewing head of the machine, the plane of the wheel being at an angle to the direction of relative movement between the mattress and the sewing machine and means for selectively moving said first wheel into and out of an operative position in which it depresses the upper surface of a mattress on the carrier against the natural resiliency of the mattress so as to relieve tension in an edge part of said upper surface immediately in advance of the sewing head while the mattress remains stationary relative to the carrier.

3. A mattress tape edge closing machine comprising a sewing machine movable relative to a mattress on a carrier therefor; means for holding the mattress stationary relative to the carrier; a de-tensioning apparatus carried with the sewing machine, a first cylindrical wheel of said apparatus in advance of the sewing head of the machine and means for selectively moving said first wheel into and out of an operative position in which it depresses the upper surface of a mattress on the carrier against the natural resiliency of the mattress so as to relieve tension in an edge part of said upper surface immediately in advance of the sewing head while the mattress remains stationary relative to the carrier, a second wheel of said apparatus in register with the sewing head and means for selectively moving said second wheel into and out of an operative position in which it depresses the upper surface of the mattress against the natural resiliency of the mattress so as to maintain at the position of the sewing head the tension relief induced by said first wheel.

4. A machine according to claim 3 in which the second wheel is movable between upper and lower mattress engaging positions.

5. A machine according to claim 4 in which the first wheel is arranged to move with the second wheel between upper and lower mattress engaging positions and in addition is movable out of engagement with the mattress while the second wheel remains in engagement with the mattress.

6. A machine according to claim 5 in which both wheels are movable together towards and away from the mattress independently of relative movement between them.

7. A machine according to claim 6 in which the mattress carrier is disposed at an acute angle to the horizontal and the axis of the first wheel is horizontal.

8. A machine according to claim 6 in which the mattress carrier is disposed horizontally.

9. A machine according to claim 3 in which the plane of the first wheel is at an angle to the direction of relative movement between the mattress and the sewing machine.

* * * * *